US011530866B2

(12) United States Patent
Kim et al.

(10) Patent No.: US 11,530,866 B2
(45) Date of Patent: Dec. 20, 2022

(54) REFRIGERATOR

(71) Applicant: LG ELECTRONICS INC., Seoul (KR)

(72) Inventors: Sungwook Kim, Seoul (KR); Kyongbae Park, Seoul (KR); Sangbok Choi, Seoul (KR); Sung Jhee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 38 days.

(21) Appl. No.: 16/992,669

(22) Filed: Aug. 13, 2020

(65) Prior Publication Data

US 2020/0370814 A1 Nov. 26, 2020

Related U.S. Application Data

(63) Continuation of application No. PCT/KR2018/012709, filed on Oct. 25, 2018.

(30) Foreign Application Priority Data

Mar. 8, 2018 (KR) ..... 10-2018-0027353

(51) Int. Cl.
*F25D 21/00* (2006.01)
*F25D 17/04* (2006.01)
*F25D 21/02* (2006.01)

(52) U.S. Cl.
CPC ..... *F25D 21/002* (2013.01); *F25D 17/04* (2013.01); *F25D 21/02* (2013.01)

(58) Field of Classification Search
CPC ..... F25D 17/04; F25D 21/002; F25D 21/02; F25D 17/062; F25D 21/006; F25D 21/08; F25D 2317/067
See application file for complete search history.

(56) References Cited

U.S. PATENT DOCUMENTS 3,355,904 A 12/1967 Sutton et al.
3,444,698 A 5/1969 Lorenz
(Continued)

FOREIGN PATENT DOCUMENTS

CN 1946977 A 4/2007
EP 0676603 A2 10/1995
(Continued)

*Primary Examiner* — Henry T Crenshaw
(74) *Attorney, Agent, or Firm* — Dentons US LLP

(57) ABSTRACT

A refrigerator of the present invention comprises: an inner case forming a storage compartment; a cold air duct guiding the flow of air within the storage compartment and forming a heat exchange space with the inner case; an evaporator disposed in the heat exchange space between the inner case and the cold air duct; a bypass passage disposed in the cold air duct so as to allow the flow of air to bypass the evaporator; a sensor disposed in the bypass flow channel and comprising a sensor housing, a sensor PCB received in the sensor housing, a heating element installed on the sensor PCB so as to generate heat when an electric current is applied thereto, a temperature element for sensing the temperature of the heating element, and a molding material with which the sensor housing is filled; a drfrosting means for removing frost formed on the surface of the evaporator; and a control unit for controlling the defrosting means on the basis of the value output from the sensor.

20 Claims, 18 Drawing Sheets

(56) References Cited

U.S. PATENT DOCUMENTS

| | | | | |
|---|---|---|---|---|
| 3,845,637 | A | 11/1974 | Shepherd | |
| 2005/0183427 | A1 | 8/2005 | Dudley et al. | |
| 2010/0154446 | A1 | 6/2010 | Oh et al. | |
| 2011/0079027 | A1* | 4/2011 | Ghan | F25D 21/10 62/277 |
| 2016/0084566 | A1 | 3/2016 | Eom et al. | |
| 2016/0290872 | A1* | 10/2016 | Ihle | G01K 1/08 |
| 2018/0200432 | A1* | 7/2018 | Yaegashi | A61M 5/16804 |
| 2019/0072310 | A1* | 3/2019 | Choi | F25D 21/025 |

FOREIGN PATENT DOCUMENTS

| | | | |
|---|---|---|---|
| EP | 2722619 | A1 | 4/2014 |
| GB | 2133130 | A | 7/1984 |
| JP | 01-312378 | A | 12/1989 |
| JP | H10197135 | A | 7/1998 |
| KR | 940011916 | A | 6/1994 |
| KR | 20000004806 | A | 1/2000 |
| KR | 101536284 | B1 | 7/2015 |
| SE | 444609 | * | 4/1986 |
| SE | 444609 | B | 4/1986 |
| WO | 2008109927 | A1 | 9/2008 |
| WO | 2014137060 | A1 | 9/2014 |
| WO | 2017131426 | A1 | 8/2017 |

* cited by examiner

Thermal flow simulation depending on flow rate

REFRIGERATOR

TECHNICAL FIELD

This specification relates to a refrigerator.

BACKGROUND ART

Refrigerators are household appliances that are capable of store objects such as foods at a low temperature in a storage chamber provided in a cabinet. Since the storage space is surrounded by heat insulation wall, the inside of the storage space may be maintained at a temperature less than an external temperature.

The storage space may be classified into a refrigerating storage space or a freezing storage space according to a temperature range of the storage space.

The refrigerator may further include an evaporator for supplying cool air to the storage space. Air in the storage space is cooled while flowing to a space, in which the evaporator is disposed, so as to be heat-exchanged with the evaporator, and the cooled air is supplied again to the storage space.

Here, if the air heat-exchanged with the evaporator is contained in moisture, when the air is heat-exchanged with the evaporator, the moisture is frozen on a surface of the evaporator to generate frost on the surface of the evaporator.

Since flow resistance of the air acts on the frost, the more an amount of frost frozen on the surface of the evaporator increases, the more the flow resistance increases. As a result, heat-exchange efficiency of the evaporator may be deteriorated, and thus, power consumption may increase.

Thus, the refrigerator further includes a defroster for removing the frost on the evaporator.

A defrosting cycle variable method is disclosed in Korean Patent Publication No. 2000-0004806 that is a prior art document.

In the prior art document, the defrosting cycle is adjusted using a cumulative operation time of the compressor and an external temperature.

However, like the prior art document, when defrosting cycle is determined only using the cumulative operation time of the compressor and the external temperature, an amount of frost (hereinafter, referred to as a frost generation amount) on the evaporator is not reflected. Thus, it is difficult accurately determine the time point at which the defrosting is required.

That is, the frost generation amount may increase or decrease according to various environments such as the user's refrigerator usage pattern and the degree to which air retains moisture. In the case of the prior art document, there is a disadvantage in that the defrosting cycle is determined without reflecting the various environments.

Accordingly, there is a disadvantage in that the defrosting does not start despite a large amount of generated frost to deteriorate cooling performance, or the defrosting starts despite a low frost generation amount to increase in power consumption due to the unnecessary defrosting.

DISCLOSURE OF THE INVENTION

Technical Problem

The present invention provides a refrigerator that is capable of determining whether a defrosting operation is performed by using a parameter that varies depending on an amount of frost generated on an evaporator.

In addition, the present invention provides a refrigerator that is capable of accurately determining a time point at which defrosting is required according to an amount of frost generated on an evaporator by using a bypass passage for sensing the generated frost.

In addition, the present invention provides a refrigerator that is capable of minimizing a length of a passage for sensing generated frost.

In addition, the present invention provides a refrigerator that is capable of accurately determining a time point at which defrosting is required even though accuracy of a sensor used for determining the time point at which the defrosting is required.

In addition, the present invention provides a refrigerator that is capable of preventing frost from being generated around a sensor for sensing generated frost.

In addition, the present invention provides a refrigerator that is capable of preventing a liquid from being introduced into a bypass passage for sensing generated frost.

Technical Solution

A refrigerator for achieving the above objects includes a cool air duct inside an inner case configured to define a storage space, and the cool air duct defines a heat-exchange space together with the inner case. An evaporator is disposed in the heat exchange space, a bypass passage is disposed to be recessed in the cool air duct, and a sensor is disposed in a bypass passage.

In the present invention, the sensor may be a sensor having an output value varying according to a flow rate of the air flowing through the bypass passage, and a time point at which defrosting for the evaporator is required may be determined by using the output value of the sensor.

In this embodiment, the sensor include a sensor housing, a sensor PCB accommodated in the sensor housing, a heat generating element installed on the sensor PCB to generate heat when current is applied, a temperature element configured to sense a temperature of the heat generating element, and a molding material filled in the sensor housing.

The refrigerator according to this embodiment includes a defroster configured to remove frost generated on a surface of the evaporator and a controller configured to control the defroster based on the output value of the sensor. When it is determined that the defrosting is required, the controller may operate the defroster.

In this embodiment, the sensing element may be installed on the sensor PCB and disposed upstream of the heat generating element with respect to a flow of the air within the bypass passage. For example, the bypass passage may extend vertically from the cool air duct, the sensing element and the heat generating element may be arranged vertically in the bypass passage, and the sensing element may be disposed below the heat generating element.

The sensing element may be disposed in a line that bisects a left and right width of the heat generating element on the sensor PCB so that the sensor sensitively reacts by heat of the heat generating element. For example, the sensing element may be disposed at a position corresponding to a central portion of the heat generating element.

The sensor housing may have an opened one surface and the other surface surrounded by the sensor PCB, the sensing element, and the heat generating element.

For example, the sensor housing may include: a seating wall on which the sensor PCB is seated; front and rear walls extending upward from front and rear ends of the seating wall with respect to an air flow direction, respectively; a sidewall configured to connect the front wall to the rear wall; a cover wall configured to connect the front wall to the rear wall, the cover wall being configured to cover the heat generating element and the sensing element; and an opening defined in an opposite side of the sidewall.

In this embodiment, the molding material may be hardened after being injected into the sensor housing through the opening to surround the sensor PCB, the sensing element, and the heat generating element.

The sensor PCB may contact the sidewall disposed at an opposite side of the opening in the sensor housing.

In this embodiment, the cover wall may include a rounded portion configured to reduce passage resistance of the air.

In addition, in this embodiment, one or more of a connection portion between the front wall and the seating wall and a connection portion between the rear wall and the seating wall may be rounded.

In another aspect, the sensor housing may include: a seating wall on which the sensor PCB is seated; front and rear walls extending upward from front and rear ends of the seating wall with respect to an air flow direction, respectively; both sidewalls configured to connect the front wall to the rear wall; and an exposure opening defined in an opposite side of the seating wall, wherein the sensor PCB may be accommodated in the sensor housing through the exposure opening, Also, the molding material may be exposed to an outside through the exposure opening. A fixing guide having a hook shape to fix a position of a wire connected to the sensor PCB may be provided on the sensor housing.

The cool air duct may include a bottom wall and both sidewalls, which define the bypass passage, and the passage cover may include a cover plate configured to cover the bypass passage in a state of being spaced apart from the bottom wall. The sensor may be disposed to be spaced apart from the bottom wall and the cover plate in the bypass passage.

Advantageous Effects

According to the proposed invention, since the time point at which the defrosting is required is determined using the sensor having the output value varying according to the amount of frost generated on the evaporator in the bypass passage, the time point at which the defrosting is required may be accurately determined.

In addition, since the sensing element is disposed in front of the heat generating element based on the air flow, the influence by the flow rate of the air to the sensing element may be maximized to improve the sensitivity of the sensing element to the air flow rate In addition, since the sensing element is disposed on the line that bisects the left and right width of the heat generating element, the sensing element may react most sensitively to the heat of the heat generating element.

In addition, in the present invention, since the sensor housing includes the rounded portion, the flow resistance of the air may be reduced, and the frost may be prevented from being generated around the sensor.

In addition, in the present invention, the sensor may be disposed to be spaced apart from the bottom surface of the bypass passage and the passage cover to prevent the frost from being generated around the sensor.

In addition, in the present invention, since the sensor according to the embodiment is disposed at the point, at which the change in flow rate is less, in the bypass passage and disposed in the central region of the passage in the fully developed flow region. Therefore, the time point at which the defrosting is required may be accurately determined even though the sensor has the low accuracy.

MODE FOR CARRYING OUT THE INVENTION

Figure 1:
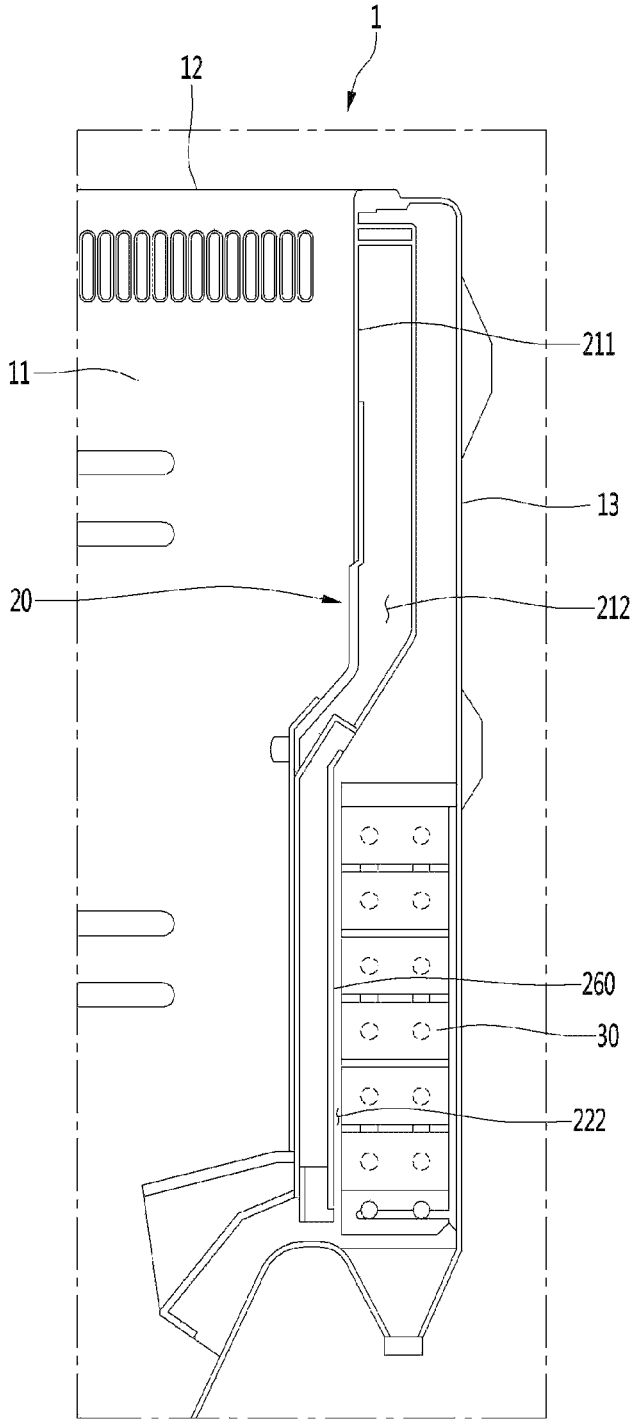
FIG. 1 is a schematic longitudinal cross-sectional view of a refrigerator according to an embodiment of the present invention.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
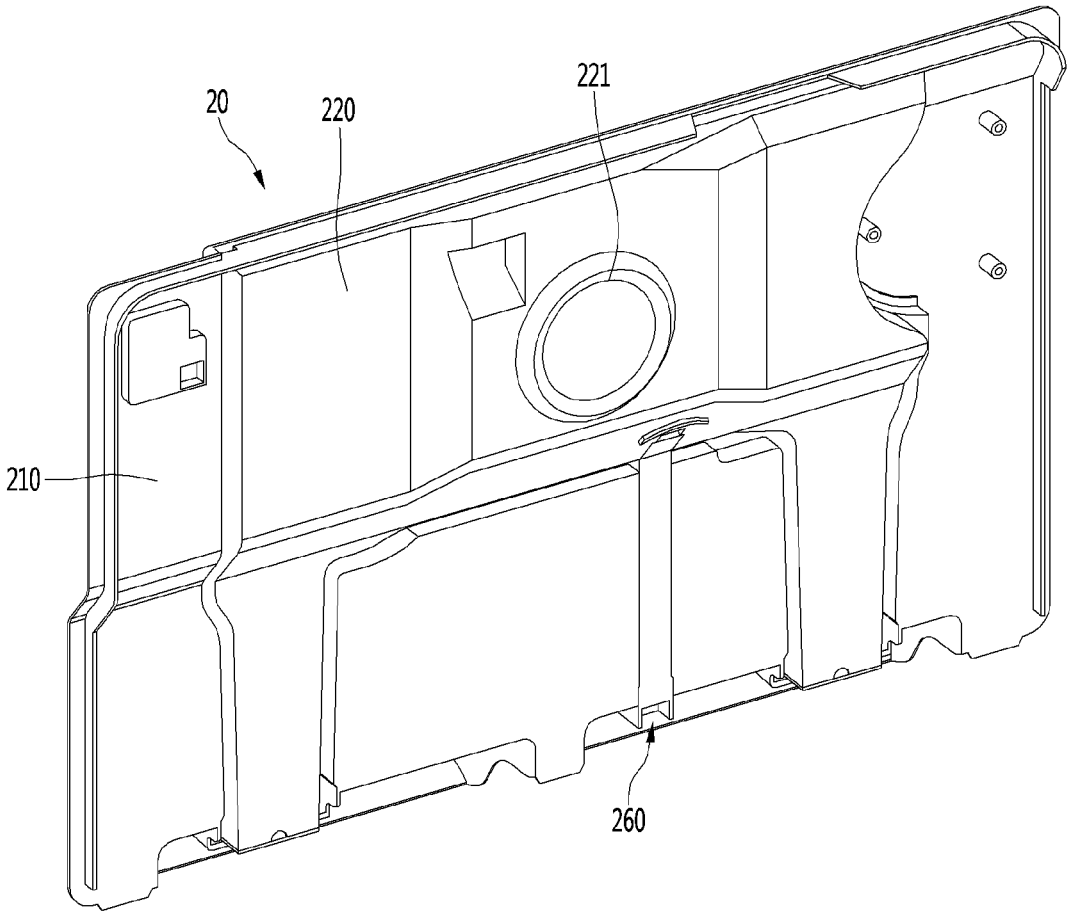
FIG. 2 is a perspective view of a cool air duct according to an embodiment of the present invention.
Figure 3:
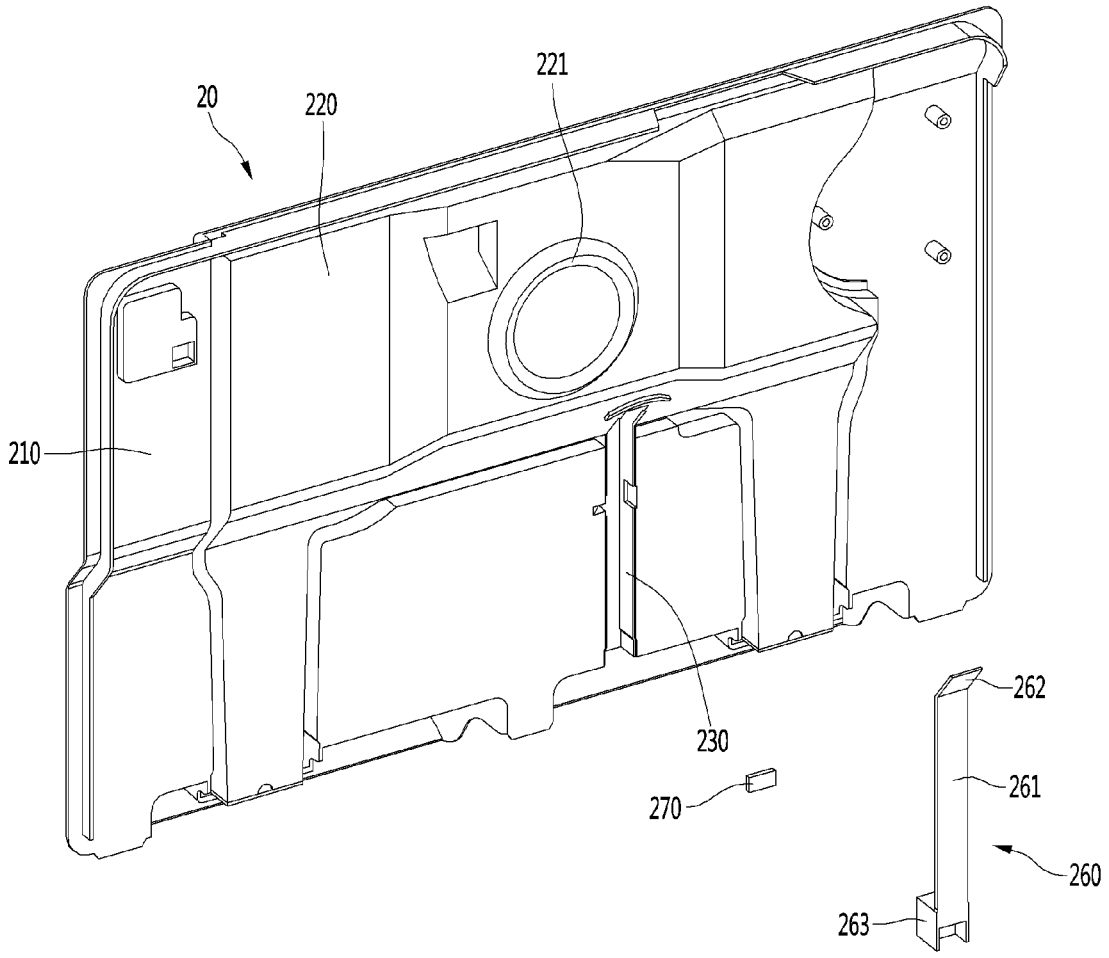
FIG. 3 is an exploded perspective view illustrating a state in which a passage cover and a sensor are separated from each other in the cool air duct.

FIG. 1 is a schematic longitudinal cross-sectional view of a refrigerator according to an embodiment of the present invention, FIG. 2 is a perspective view of a cool air duct according to an embodiment of the present invention, and FIG. 3 is an exploded perspective view illustrating a state in which a passage cover and a sensor are separated from each other in the cool air duct.

Referring to FIGS. 1 to 3, a refrigerator 1 according to an embodiment of the present invention may include an inner case 12 defining a storage space 11.

The storage space may include one or more of a refrigerating storage space and a freezing storage space.

A cool air duct 20 providing a passage, through which cool air supplied to the storage space 11 flows, in a rear space of the storage space 11. Also, an evaporator 30 is disposed between the cool air duct 20 and a rear wall 13 of the inner case 12. That is, a heat exchange space 222 in which the evaporator 30 is disposed is defined between the cool air duct 20 and the rear wall 13.

Thus, air of the storage space 11 may flow to the heat exchange space 222 between the cool air duct 20 and the rear wall 13 of the inner case 12 and then be heat-exchanged with the evaporator 30. Thereafter, the air may flow through the inside of the cool air duct 20 and then be supplied to the storage space 11.

The cool air duct 20 may include, but is not limited thereto, a first duct 210 and a second duct 220 coupled to a rear surface of the first duct 210.

A front surface of the first duct 210 is a surface facing the storage space 11, and a rear surface of the first duct 220 is a surface facing the rear wall 13 of the inner case 12.

A cool air passage 212 may be provided between the first duct 210 and the second duct 220 in a state in which the first duct 210 and the second duct 220 are coupled to each other.

Also, a cool air inflow hole 221 may be defined in the second duct 220, and a cool air discharge hole 211 may be defined in the first duct 210.

A blower fan (not shown) may be provided in the cool air passage 212. Thus, when the blower fan rotates, air passing through the evaporator 13 is introduced into the cool air passage 212 through the cool air inflow hole 221 and is discharged to the storage space 11 through the discharge hole 211.

The evaporator 30 is disposed between the cool air duct 20 and the rear wall 13. Here, the evaporator 30 may be disposed below the cool air inflow hole 221.

Thus, the air in the storage space 11 ascends to be heat-exchanged with the evaporator 30 and then is introduced into the cool air inflow hole 221.

According to this arrangement, when an amount of frost generated on the evaporator 30 increases, an amount of air passing through the evaporator 30 may be reduced to deteriorate heat exchange efficiency.

In this embodiment, a time point at which defrosting for the evaporator 30 is required may be determined using a parameter that is changed according to the amount of frost generated on the evaporator 30.

For example, the cool air duct 20 may further include a frost generation sensing portion configured so that at least a portion of the air flowing through the heat exchange space 222 is bypassed and configured to determine a time point, at which the defrosting is required, by using the sensor having a different output according to a flow rate of the air.

The frost generation sensing portion may include a bypass passage 230 bypassing at least a portion of the air flowing through the heat exchange space 222 and a sensor 270 disposed in the bypass passage 230.

Although not limited, the bypass passage 230 may be provided in a recessed shape in the first duct 210. Alternatively, the bypass passage 230 may be provided in the second duct 220.

The bypass passage 230 may be provided by recessing a portion of the first duct 210 or the second duct 220 in a direction away from the evaporator 30.

The bypass passage 230 may extend from the cool air duct 20 in a vertical direction.

The bypass passage 230 may be disposed to face the evaporator 30 within a left and right width range of the evaporator 30 so that the air in the heat exchange space 222 is bypassed to the bypass passage 230.

The frost generation sensing portion may further include a passage cover 260 that allows the bypass passage 230 to be partitioned from the heat exchange space 222.

The passage cover 260 may be coupled to the cool air duct 20 to cover at least a portion of the bypass passage 230 extending vertically.

The passage cover 260 may include a cover plate 261, an upper extension portion 262 extending upward from the cover plate 261, and a barrier 263 provided below the cover plate 261. A specific shape of the passage cover 260 will be described later with reference to the drawings.

Figure 4:
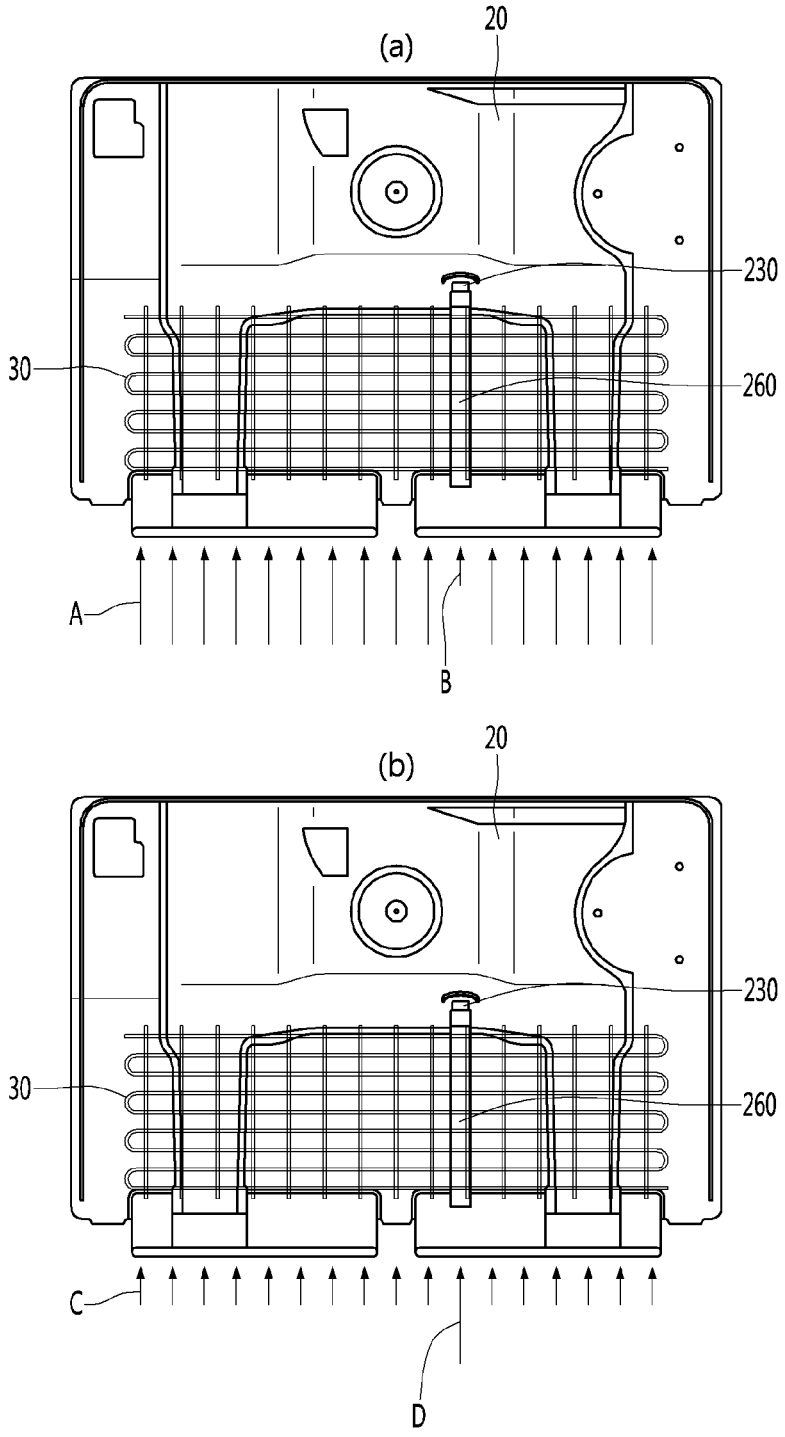
FIG. 4 is a view illustrating a flow of air in a heat exchange space and a bypass passage before and after frost is generated.

FIG. 4 is a view illustrating a flow of air in the heat exchange space and the bypass passage before and after frost is generated.

(a) of FIG. 4 illustrates a flow of air before frost is generated, and (b) of FIG. 4 illustrates a flow of air after frost is generated. In this embodiment, as an example, it is assumed that a state after a defrosting operation is complicated is a state before frost is generated.

First, referring to (a) of FIG. 4, in the case in which frost does not exist on the evaporator 30, or an amount of generated frost is remarkably small, most of the air passes through the evaporator 30 in the heat exchange space 222 (see arrow A). On the other hand, some of the air may flow through the bypass passage 230 (see arrow B).

Referring to (b) of FIG. 4, when the amount of frost generated on the evaporator 30 is large (when the defrosting is required), since the frost of the evaporator 30 acts as flow resistance, an amount of air flowing through the heat exchange space 222 may decrease (see arrow C), and an amount of air flowing through the bypass passage 230 may increase (see arrow D).

As described above, the amount (or flow rate) of air flowing through the bypass passage 230 varies according to an amount of frost generated on the evaporator 30.

In this embodiment, the sensor 270 may have an output value that varies according to a change in flow rate of the air flowing through the bypass passage 230. Thus, whether the defrosting is required may be determined based on the change in output value.

Hereinafter, a structure and principle of the sensor 270 will be described.

Figure 5:
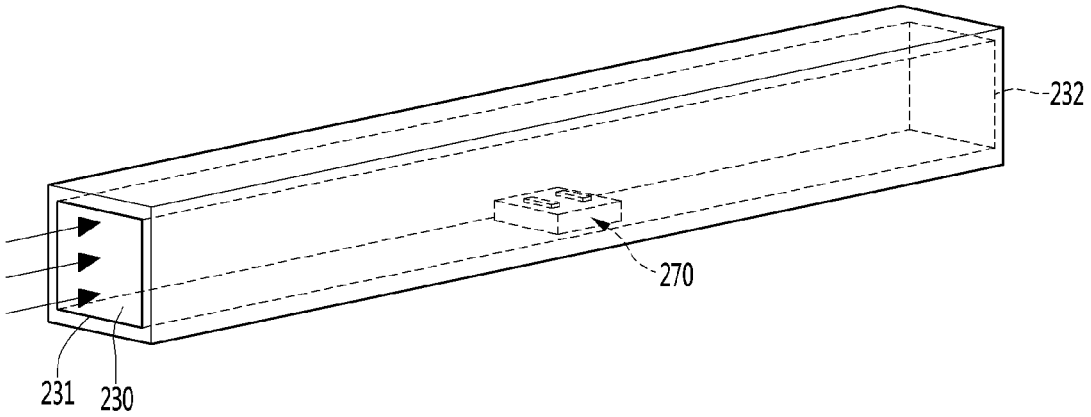
FIG. 5 is a schematic view illustrating a state in which a sensor is disposed in the bypass passage.
Figure 6:
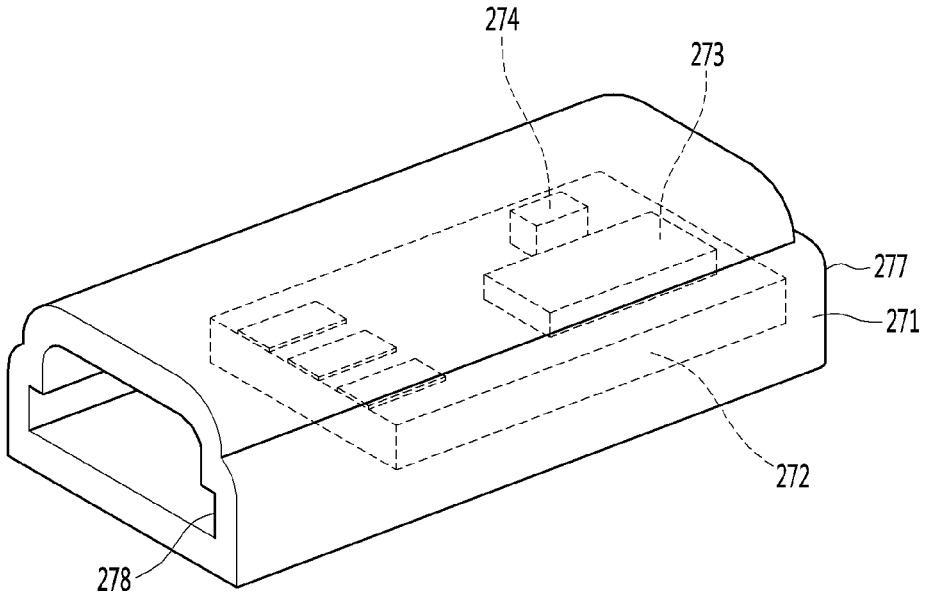
FIG. 6 is a view of the sensor according to an embodiment of the present invention.
Figure 7:
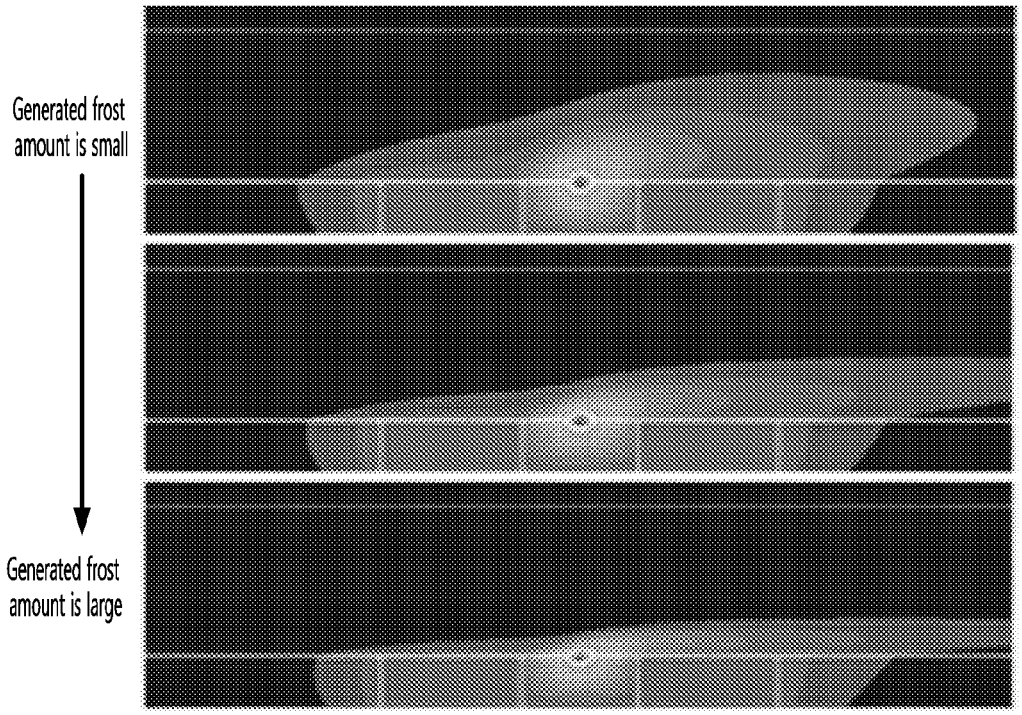
FIG. 7 is a view illustrating a thermal flow around the sensor depending on a flow of air flowing through the bypass passage.

FIG. 5 is a schematic view illustrating a state in which the sensor is disposed in the bypass passage, FIG. 6 is a view of the sensor according to an embodiment of the present invention, and FIG. 7 is a view illustrating a thermal flow around the sensor depending on a flow of air flowing through the bypass passage.

Referring to FIGS. 5 to 7, the sensor 270 may be disposed at one point in the bypass passage 230. Thus, the sensor 270 may contact the air flowing along the bypass passage 230, and an output value of the sensor 270 may be changed in response to a change in a flow rate of air.

The sensor 270 may be disposed at a position spaced from each of an inlet 231 and an outlet 232 of the bypass passage 230. A specific location of the sensor 270 in the bypass passage 230 will be described later with reference to the drawings.

Since the sensor 270 is disposed on the bypass passage 230, the sensor 270 may face the evaporator 30 within the left and right width range of the evaporator 30.

The sensor 270 may be, for example, a generated heat temperature sensor. Particularly, the sensor 270 may include a sensor PCB 272, a heat generating element 273 installed on the sensor PCB 272, and a sensing element 274 installed on the sensor PCB 272 to sense a temperature of the heat generating element 273.

The heat generating element 273 may be a resistor that generates heat when current is applied.

The sensing element 274 may sense a temperature of the heat generating element 273.

When a flow rate of air flowing through the bypass passage 230 is low, since a cooled amount of the heat generating element 273 by the air is small, a temperature sensed by the sensing element 274 is high.

On the other hand, if a flow rate of the air flowing through the bypass passage 230 is large, since the cooled amount of the heat generating element 273 by the air flowing through the bypass passage 230 increases, a temperature sensed by the sensing element 274 decreases.

The sensor PCB 272 may determine a difference between a temperature sensed by the sensing element 274 in a state in which the heat generating element 273 is turned off and a temperature by the sensing element 274 in a state in which the heat generating element 273 is turned on.

The sensor PCB 272 may determine whether the difference value between the states in which the heat generating element 273 is turned on/off is less than a reference difference value.

For example, referring to FIGS. 4 and 7, when an amount of frost generated on the evaporator 30 is small, a flow rate of air flowing to the bypass passage 230 is small. In this case, a heat flow of the heat generating element 273 is little, and a cooled amount of the heat generating element 273 by the air is small.

On the other hand, when the amount of frost generated on the evaporator 30 is large, a flow rate of air flowing to the bypass passage 230 is large. Then, the heat flow and cooled amount of the heat generating element 273 are large by the air flowing along the bypass passage 230.

Thus, the temperature sensed by the sensing element 274 when the amount of frost generated on the evaporator 30 is large is less than that sensed by the sensing element 274 when the amount of frost generated on the evaporator 30 is small.

Thus, in this embodiment, when the difference between the temperature sensed by the sensing element 274 in the state in which the heat generating element 273 is turned on and the temperature by the sensing element 274 in the state in which the heat generating element 273 is turned off is less than the reference temperature difference, it may be determined that the defrosting is required.

According to this embodiment, the sensor 270 may sense a variation in temperature of the heat generating element 273, which varies by the air of which a flow rate varies according to the amount of generated frost to accurately determine a time point, at which the defrosting is required, according to the amount of frost generated on the evaporator 30.

The sensor 270 may further include a sensor housing 271 to prevent the air flowing through the bypass passage 230 from directly contacting the sensor PCB 272, the heat generating element 273, and the temperature sensor 274.

In the sensor housing 271, a wire connected to the sensor PCB 271 is withdrawn in a state in which one side of the sensor housing 271 is opened. Thereafter, the opened portion may be covered by the cover portion.

The sensor housing 271 may surround the sensor PCB 272, the heat generating element 273, and the temperature sensor 274. Thus, the sensor housing 271 serves as a waterproof.

Figure 8:
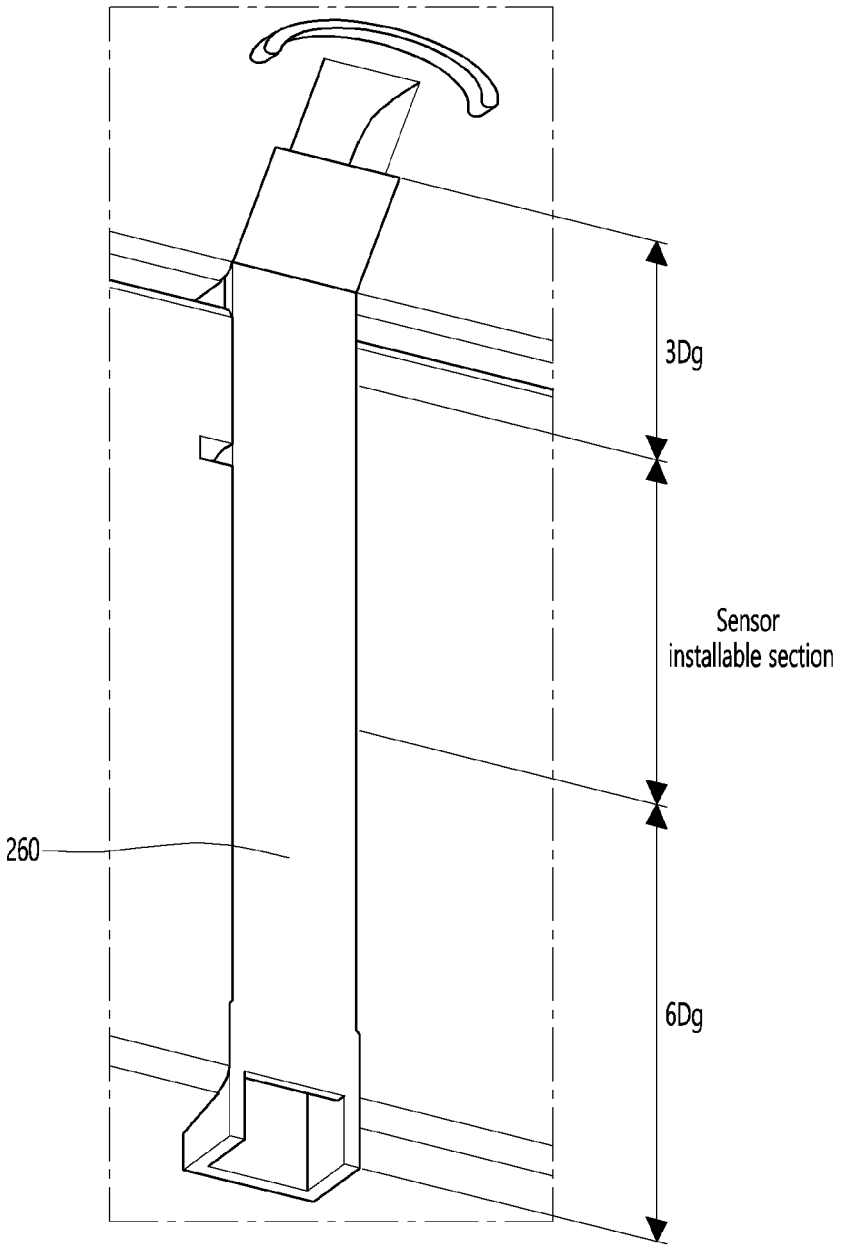
FIG. 8 is a view illustrating an installable position of the sensor in the bypass passage.
Figure 9:
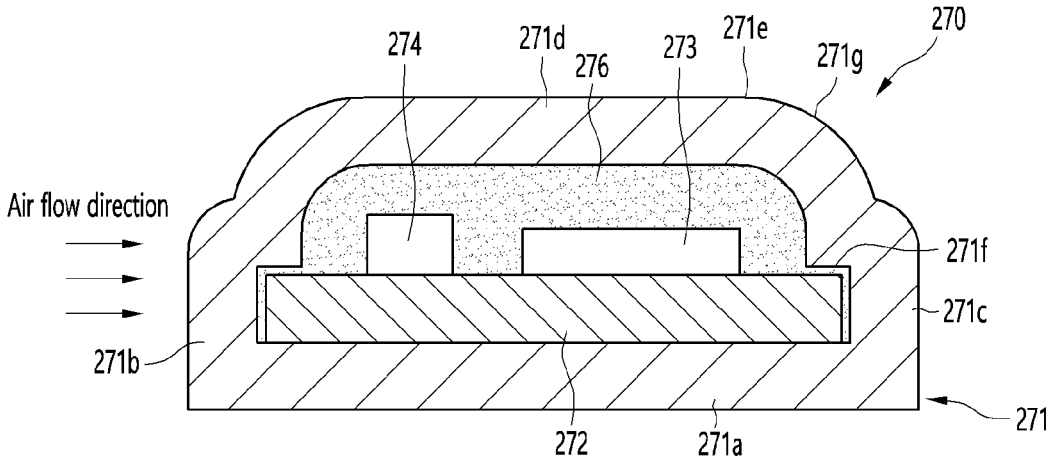
FIG. 9 is a cross-sectional view of a sensor according to a first embodiment of the present invention.
Figure 10:
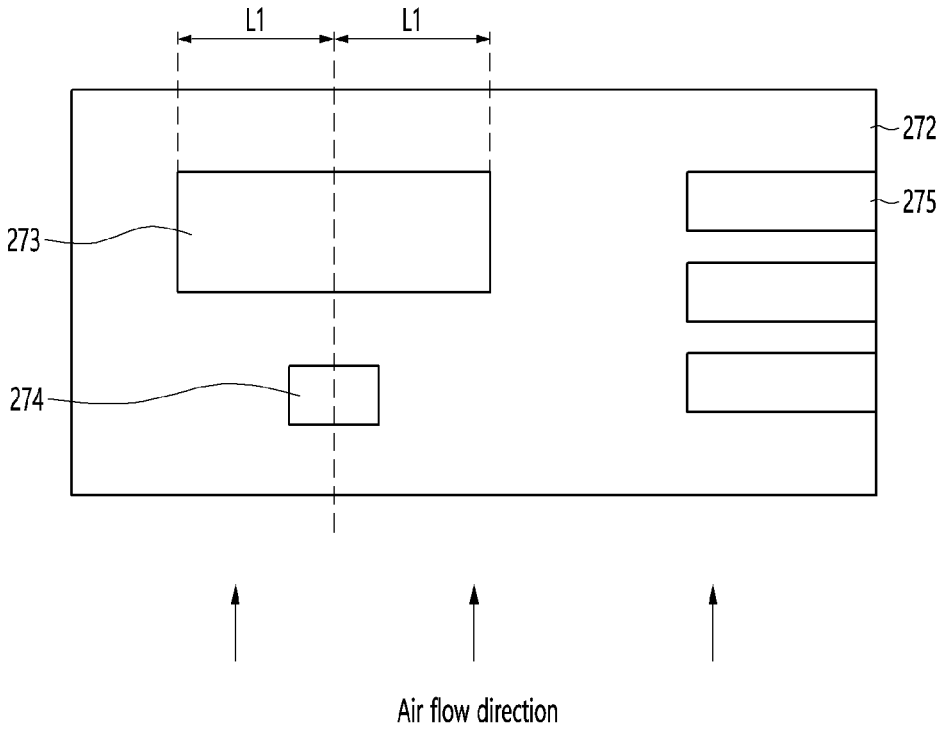
FIG. 10 is a plan view illustrating an arrangement of a heat generating element and a sensing element on a sensor PCB according to the first embodiment of the present invention.

FIG. 8 is a view illustrating an installable position of the sensor in the bypass passage, FIG. 9 is a cross-sectional view of a sensor according to a first embodiment of the present invention, and FIG. 10 is a plan view illustrating an arrangement of a heat generating element and a sensing element on a sensor PCB according to the first embodiment of the present invention.

Figure 11:
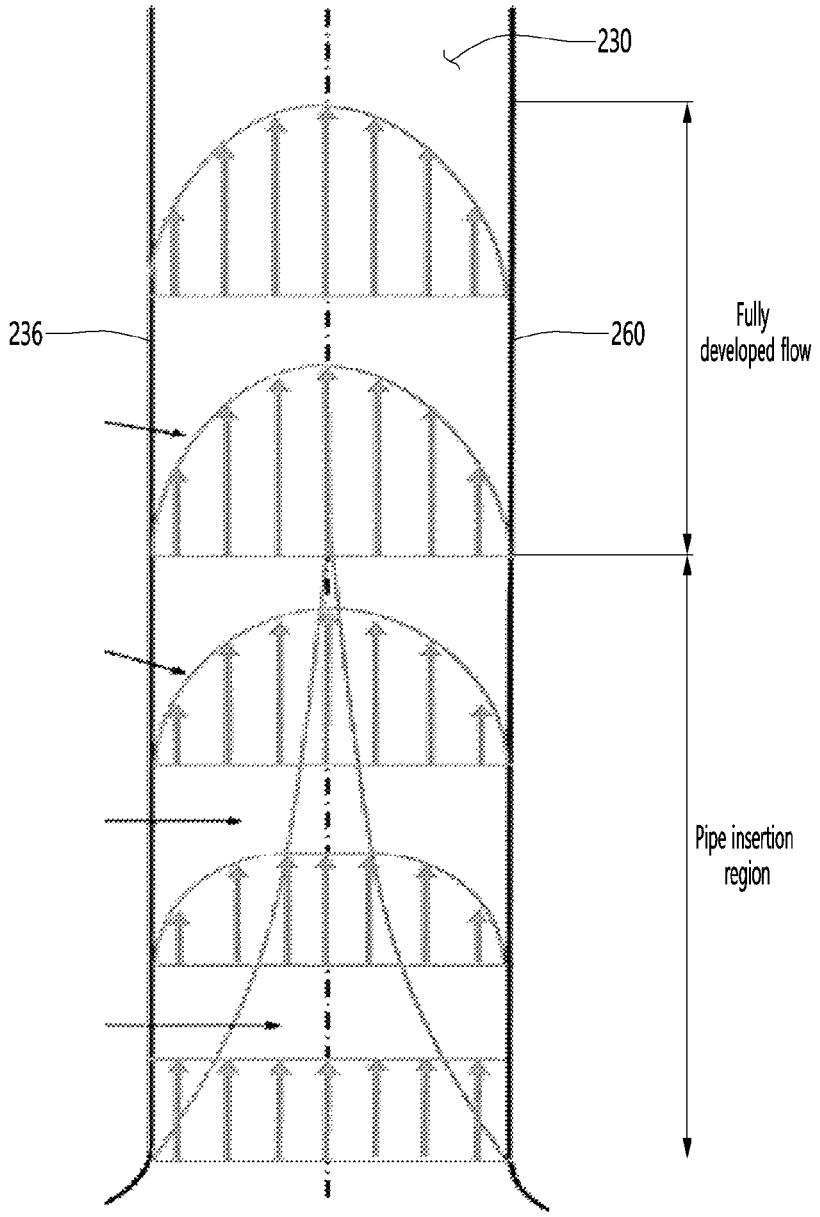
FIG. 11 is a view illustrating an air flow pattern in a bypass passage.
Figure 12:
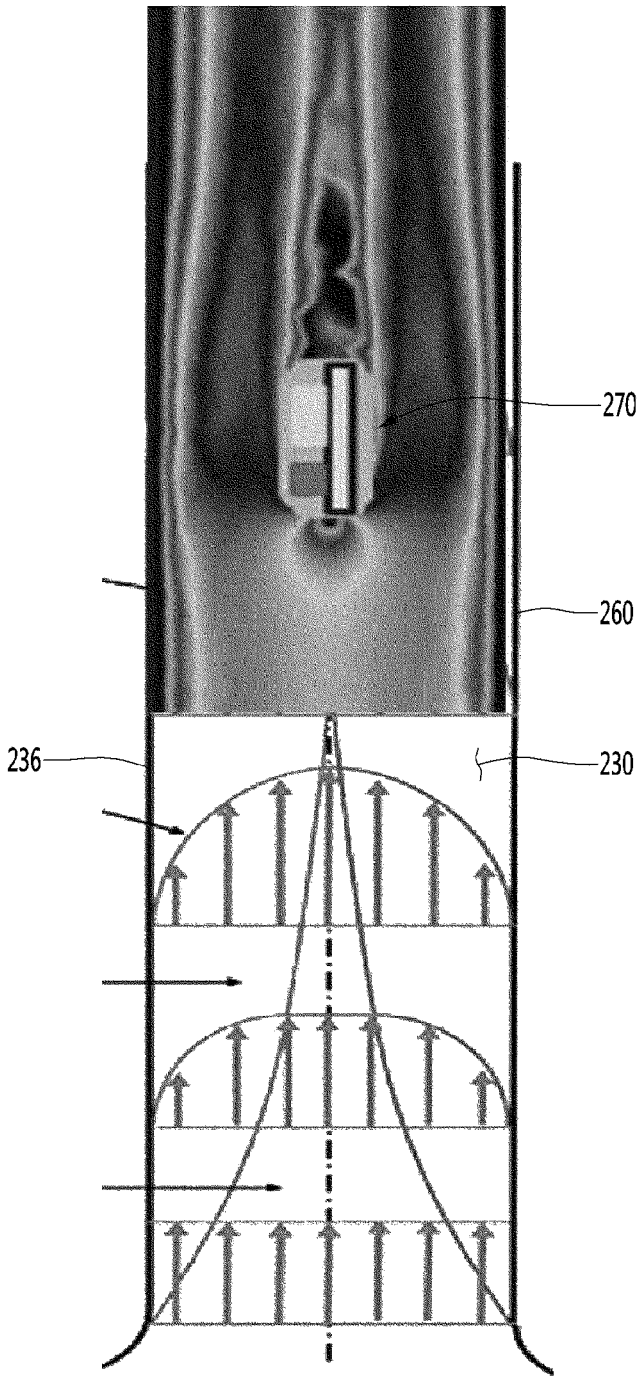
FIG. 12 is a view illustrating a flow of air in a state in which the sensor is installed in the bypass passage.

FIG. 11 is a view illustrating an air flow pattern in a bypass passage, and FIG. 12 is a view illustrating a flow of air in a state in which the sensor is installed in the bypass passage.

Referring to FIGS. 5 and 8 to 12, the passage cover 260 may cover a portion of the bypass passage 230 in the vertical direction.

Thus, the air may flow along a region (that is partitioned from the heat exchange space) of the bypass passage 230, in which the passage cover 260 substantially exists.

As described above, the sensor 270 may be disposed to be spaced apart from the inlet 231 and the outlet 232 of the bypass passage 230.

The sensor 270 may be disposed at a position at which the sensor 270 is less affected by a change in flow of the air flowing through the bypass passage 230.

For example, the sensor 270 may be disposed at a position (hereinafter, referred to as an "inlet reference position") that is spaced at least 6 Dg (or 6*diameter of the passage) from the inlet (actually, a lower end of the passage cover 260) of the bypass passage 230.

Alternatively, the sensor 270 may be disposed at a position (hereinafter, referred to as an "outlet reference position") that is spaced at least 3 Dg (or 3*diameter of the passage) from the outlet (actually, an upper end of the passage cover 260) of the bypass passage 230.

A change in flow of air is severe while the air is introduced into the bypass passage 230 or discharged from the bypass passage 230. If the change in flow of air is large, it may be determined that the defrosting is required despite a small amount of generated frost.

Thus, in this embodiment, when air flows along the bypass passage 230, the sensor 270 is installed at a position at which the change in flow is small to reduce detection errors.

For example, the sensor 270 may be disposed within a range between the inlet reference position and the outlet reference position. The sensor 270 may be disposed closer to the outlet reference position than the inlet reference position. Therefore, the sensor 270 may be disposed closer to the outlet 232 than the inlet 231 in the bypass passage 230.

Since the flow is stabilized at least at the inlet reference position, and the flow is stabilized until the outlet reference position, if the sensor 270 is disposed close to the outlet reference position, the air having the stabilized flow may contact the sensor 270.

Thus, since it is not affected other than the flow change due to the large and small amount of generated frost, the sensing accuracy of the sensor 270 may be improved.

Also, referring to FIG. 11, the farther away from the inlet 231 in the bypass passage 230, the air becomes a fully developed flow form.

Since the sensor 270 is very sensitive to the change in flow of air, when the sensor 270 is disposed at a center of the bypass passage 230 at the point at which the fully developed flow occurs, the sensor 270 may accurately sense the change in flow.

Thus, as illustrated in FIG. 12, the sensor 270 may be installed in a central region within the bypass passage 230.

Here, the central region of the bypass passage 230 is a region including a portion at which a distance between, the bottom wall 236 of the recessed portion of the bypass passage 230 and the passage cover 260 is bisected. That is, a portion of the sensor 270 may be disposed at a point at which the distance between the bottom wall 236 of the recessed portion of the bypass passage 230 and the passage cover 260 is bisected.

Referring to FIG. 12, the sensor 270 may be spaced apart from the bottom wall 236 of the bypass passage 230 and the passage cover 260.

Thus, a portion of the air in the bypass passage 230 may flow through a space between the bottom wall 236 and the sensor 270, and the other portion of the air may flow through a space between the sensor 270 and the passage cover 260.

In summary, the sensor 270 has to be installed in the central region of the passage at the point at which the change in flow of air is minimized in the bypass passage 230 and at the point at which the fully developed flow flows so as to improve accuracy sensing.

Due to this arrangement, the sensor 270 may sensitively react to the change in flow of air according to the large or small amount of generated frost.

That is, a variation in temperature sensed by the sensor 270 may increase.

As described above, when the variation in temperature sensed by the sensor 270 increases, it is possible to determine the time point at which the defrosting is required even if the temperature sensing accuracy of the sensor 270 itself is lowered. Since the temperature sensing accuracy of the sensor itself is related to prices, it is possible to determine the time point at which the defrosting is required even if the sensor 270 having a relatively low price due to low accuracy is used.

Referring to FIG. 9, the sensing element 274 and the heat generating element 273 may be arranged in a direction parallel to the air flow direction.

Here, the sensing element 274 is disposed upstream of the heat generating element 273 to maximize the influence of the flow of the air.

Thus, since the sensing element 274 sensing a temperature of the heat generating element 273 is disposed in front of the heat generating element 273 based on the flow of the air, the sensing element may be sensitive to a change in flow rate of the air. That is, the periphery of the sensing element 274 may be cooled by the air that is not affected by the heat generating element 273.

For example, since the bypass passage 230 extends in the vertical direction, the sensing element 274 is disposed below the heat generating element 273 while the sensor 270 is disposed in the bypass passage 230.

The sensing element 274 may be disposed on a line that bisects the left and right width of the heat generating element 273 so that the sensing element 274 reacts most sensitively by the heat of the heat generating element 273. That is, the sensing element 274 may be disposed in a region corresponding to a central portion of the heat generating element 273.

The sensor PCB 272 may be provided with a terminal 275 for connecting a wire. The terminal 275 may be disposed at a side of the heat generating element 273 and the sensing element 274 in the left and right direction.

Referring to FIGS. 6 and 9, the sensor housing 271 may be, for example, an injection mold made of a plastic injection material. Although not limited, the sensor housing 271 may be formed of acrylonitrile-butadiene-styrene (ABS) or polyvinyl alcohol (PVA).

One surface of the sensor housing 271 may be opened, and the other surface of the sensor housing 271 may surround the sensor PCB 272, the sensing element 274, and the heat generating element 273.

The sensor housing 271 may include a seating wall 271*a* on which the sensor PCB 272 is seated and front and rear walls 271*b* and 271*c*, which respectively extend upward from a front end and a rear end of the seating wall 271*a* with respect to the air flow direction.

In addition, the sensor housing 271 may include a cover wall 271*d* covering the front wall 271*b* and the rear wall 271*c*.

The cover wall 271*d* includes a PCB cover portion 271*f* covering a portion of a top surface of the sensor PCB 272 while the sensor PCB 272 is seated on the seating surface 271*a* and an element cover portion 271*e* extending upward from the PCB cover portion 271*f*.

The element cover portion 271*e* is spaced apart from the sensor PCB 272, the heat generating element 273, and the sensing element 274. Thus, a space in which the molding material 276 is filled is defined between the element cover part 271*e*, the sensor PCB 272, the heat generating element 273, and the sensing element 274. The molding material 276 may be, for example, epoxy.

In this embodiment, since the heat generating element 273 generates heat, heat generated from the heat generating element 273 may be transferred to the sensor housing 271. Here, the heat to be transferred to the sensor housing 271 has to be rapidly cooled to prevent the sensor housing 271 from being thermally deformed.

Since the heat generating element 273 is provided on the surface of the sensor PCB 272, the heat of the heat generating element 273 is transferred to the sensor PCB 272, and the heat transferred to the sensor PCB 272 is transferred to the seating wall 271*a*, which directly contacts the sensor PCB 272, on the sensor PCB 272. Since the heat is transferred to the seating wall 271*a*, a heat dissipation portion of the entire sensor housing 271 is limited.

Since the sensor PCB 272 and the heat generating element 273 are spaced apart from the cover wall 271*d*, when there is no material between the sensor PCB 272 and the cover wall 271*d*, the heat of the heat generating element 274, which is transferred to the cover wall 271*d*, may be small.

Thus, in this embodiment, the molding material 276 may be filled into the space between the sensor PCB 272 and the cover wall 271*d* so that the molding material 276 conducts the heat of the heat generating element 273 to the cover wall 271*d*. Thus, the heat may be smoothly dissipated through the cover wall 271*d* to minimize the thermal deformation of the sensor housing 271.

A distance between the front wall 271*b* and the rear wall 271*c* may be the same as the front and rear length of the sensor PCB 272 with respect to the air flow direction (referred to as a "first direction").

In this case, the front wall 271*b*, the rear wall 271*c*, and the sensor PCB 272 may contact each other to prevent the sensor PCB 272 to moving forward and backward by the front wall 271*b* and the rear wall 271*c*.

The PCB cover portion 271*f* may cover the sensor PCB 272 at an opposite side of the seating wall 271*a* with respect to the sensor PCB 272.

The arrangement direction of the PCB cover part 271*f*, the sensor PCB 272, and the seating wall 271*a* may be a second direction (a vertical direction in the drawings) perpendicular to the flow direction (first direction) of the air.

Since the sensor PCB 272 is disposed between the PCB cover portion 271*f* and the seating wall 271*a*, the sensor PCB 272 the movement of the sensor PCB 272 in the second direction may be restricted by the PCB cover portion 271*f* and the seating wall 271*a*.

The cover wall 271*d* may include a rounded portion 271*g* to reduce air flow resistance.

The rounded portion 271*g* may be disposed adjacent to the front wall 271*b* and the rear wall 271*c* on the cover wall 271*d* or may be disposed at a portion, at which the front wall 271*b* and the rear wall 271*c* are connected to each other, on the cover wall 271*d*.

Alternatively, the rounded portion 271*g* may be disposed on the connection portion between the PCB cover portion 271*f* and the element cover portion 271*e*.

In the defrosting process for the evaporator 30, defrosting water may flow through the bypass passage 230. Also, since the cover wall 271*d* includes the rounded portion 271*g*, a phenomenon in which the defrosting water is generated on the surface of the sensor housing 271 may be prevented to prevent the defrosting water from being condensed on the surface of the sensor housing 271.

Also, the connection portion between the seating wall 271*a* and the front wall 271*b* and the connection portion of the seating wall 271*a* and the rear wall 271*c* may also be rounded.

In the sensor housing 271, a length (left and right length in FIG. 6) in the third direction perpendicular to each of the first direction and the second direction is greater than that of the sensor PCB 272 in the third direction.

Also, the sidewall 277 is disposed at one side of the sensor housing 271 in the third direction, and an opening 278 is defined in the other side of the sensor housing 271.

Thus, the sensor PCB 272 may be inserted into the sensor housing 271 through the opening 278.

The sensor PCB 272 may contact the sidewall 277 of the sensor housing 271. In this case, the movement of the sensor PCB 272 may be restricted by the sidewall 277.

In the state in which the sensor PCB 272 is accommodated in the sensor housing 271, the sensor PCB 272 is spaced apart from the opening 278 of the sensor housing 271.

When the spaced distance between the sensor PCB 272 and the opening 278 is secured over a certain distance, a thickness between the sensor PCB 272 and the opening 278 in the molding material 276 injected into the sensor housing 271 through the opening 278 may be sufficiently secured. Thus, moisture may be effectively prevented from being introduced from the outside of the sensor housing 271 into the sensor housing 271.

Although not limited, the molding material 276 between the sensor PCB 272 and the opening 278 may have a thickness of about 5 mm or more.

Here, the wire connected to the terminal 275 may extend to the outside of the sensor housing 271 by the opening 278. In this state, the molding material 276 may be injected into the sensor housing 271.

When the molding material 276 is hardened after the molding material 276 is injected into the sensor housing 271, the position of the sensor housing 271 may be fixed by the hardened molding material.

According to this embodiment, in the process of assembling the sensor 270, the position of the sensor PCB 272 in the sensor housing 271 may be almost the same to minimize dispersion of the plurality of manufactured sensors 270

Figure 13:
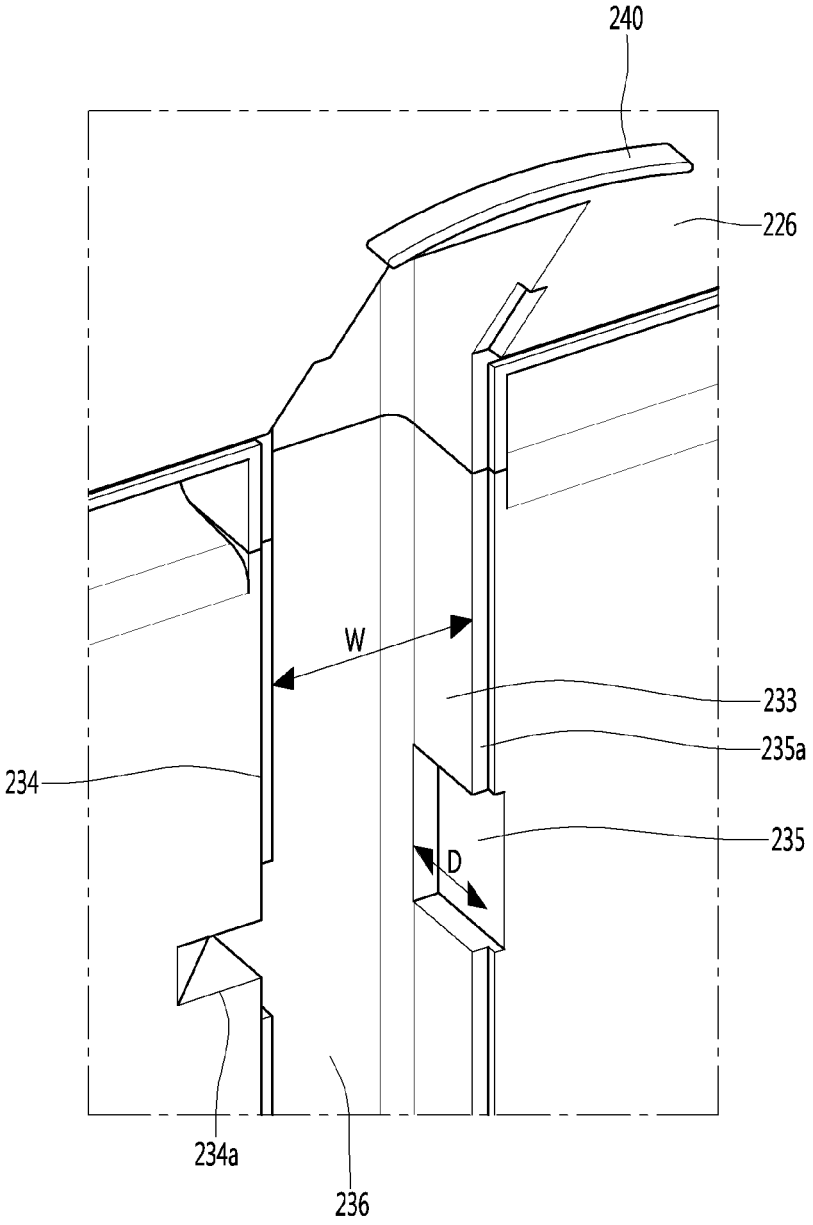
FIG. 13 is an enlarged view illustrating the bypass passage and a rib for preventing defrosting water from being introduced according to an embodiment of the present invention.

FIG. 13 is an enlarged view illustrating the bypass passage and a rib for preventing defrosting water from being introduced according to an embodiment of the present invention.

Referring to FIGS. 12 and 13, since the air flowing through the bypass passage 230 contains moisture, frost may be generated in the passage due to a capillary phenomenon in a space between the sensor 270 and a wall defined by the bypass passage 230 in the bypass passage 230.

Thus, in this embodiment, the sensor 270 may be spaced apart from the bottom wall 236 of the bypass passage 230 and the passage cover 260 to prevent the frost from being generated in the passage.

Although not limited, the sensor 270 may be designed to be spaced at least 1.5 mm from each of the bottom wall 236 and the passage cover 260 (which may be referred to as a "minimum separation distance").

Thus, a depth of the bypass passage 230 may be equal to or larger than a thickness of (2*the minimum separation distance) and the sensor 270.

The left and right width W of the bypass passage 230 may be greater than the depth.

If the left and right width W of the bypass passage 230 are larger than the depth, when the air flows to the bypass passage 230, a contact area between the air and the sensor 270 increases, and thus, the variation in temperature detected by the sensor 270 may increase.

The cool air duct 20 may be provided with a blocking rib 240 for preventing a liquid such as defrosting water or moisture generated by being melted during the defrosting process from being introduced into the bypass passage 230.

The blocking rib 240 may be disposed above the outlet 232 of the bypass passage 230. The blocking rib 240 may have a protrusion shape protruding from the cool air duct 20.

The blocking rib 240 may allow the dropping liquid to be spread horizontally so as to prevent the liquid from being introduced into the bypass passage 230.

The blocking rib 240 may be provided horizontally in a straight line shape or be provided in a rounded shape to be convex upward.

The blocking rib 240 may be disposed to overlap with the entire left and right side of the bypass passage 230 in the vertical direction and may have a minimum left and right length greater than the right and left width of the bypass passage 230.

When the blocking rib 240 is provided in the cool air duct 20, since the blocking rib 240 serves as flow resistance of air, the minimum left and right length of the blocking rib 240 may be set to two times or less of the right and left width W.

As the blocking rib 240 is disposed closer to the bypass passage 230, the length of the blocking rib 240 may be shortened. On the other hand, the defrosting water may flow over the blocking rib 240 and then be introduced into the bypass passage 230.

Thus, the blocking rib 240 may be spaced apart from the bypass passage 230 in the vertical direction, and the maximum separation distance may be set within a range of the right and left width W of the bypass passage 230.

The cool air duct 20 may include a sensor installation groove 235 recessed to install the sensor 270.

The cool air duct 20 may include a bottom wall 236 and both sidewalls 233 and 234 for providing the bypass passage 230, and the sensor installation groove 235 may be recessed in one or more of both the sidewall 233 and 234.

In the state in which the sensor 270 is installed in the sensor installation groove 235, the sensor 270 may be spaced the minimum separation distance from the bottom wall 236 and the passage cover 260 as described above.

For this, a depth (D) of the sensor installation groove 235 may be greater than a thickness of the sensor 270 in the horizontal direction in FIG. 12.

Also, a guide groove 234*a* for guiding a wire (not shown) connected to the sensor 270 may be defined in one sidewall of the sidewalls 233 and 234. Thus, the wire may be withdrawn out of the bypass passage 230 by the guide groove 234*a* while the sensor 270 is installed in the sensor installation groove 235.

Figure 14:
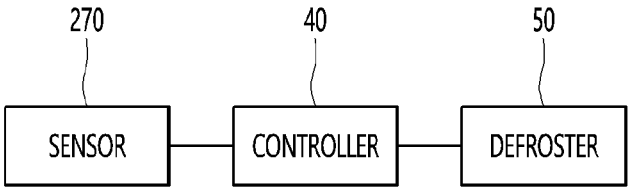
FIG. 14 is a control block diagram of a refrigerator according to the first embodiment of the present invention.

FIG. 14 is a control block diagram of a refrigerator according to the first embodiment of the present invention.

Referring to FIG. 14, the refrigerator 1 according to an embodiment of the present invention may further include a defroster 50 operating to defrost the evaporator 30 and a controller 40 controlling the defroster 50.

The defroster 50 may include, for example, a heater. When the heater is turned on, heat generated by the heater is transferred to the evaporator 30 to melt frost generated on the surface of the evaporator 30.

The controller 40 may control the heat generating element 273 of the sensor 270 so as to be turned on with a regular cycle.

To determine the time point at which the defrosting is required, the heat generating element 273 may be maintained in the turn-on state for a certain time, and a temperature of the heat generating element 273 may be sensed by the sensing element 274.

After the heat generating element 273 is turned on for the certain time, the heat generating element 274 may be turned off, and the sensing element 273 may sense the temperature of the off heat generating element 273. Also, the sensor PCB 272 may determine whether a maximum value of the temperature difference value in the turn on/off state of the heat generating element 273 is equal to or less than the reference difference value.

Then, when the maximum value of the temperature difference value in the turn on/off state of the heat generating element 273 is equal to or less than the reference difference value, it is determined that defrosting is required. Thus, the defroster 50 may be turned on by the controller 40.

In the above, it has been described as determining whether the temperature difference value of the turn on/off state of the heat generating element 273 in the sensor PCB 272 is equal to or less than the reference difference value. On the other hand, the controller 40 may determine whether the temperature difference value in the turn on/off state of the heat generating element 273 is equal to or less than the reference difference value and then control the defroster 50 according to the determination result.

Figure 15:
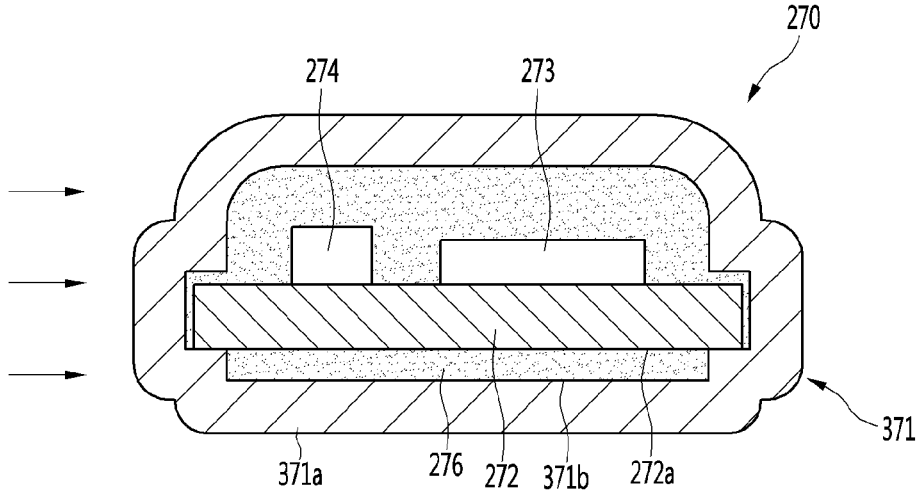
FIG. 15 is a cross-sectional view of a sensor according to a second embodiment of the present invention.

FIG. 15 is a cross-sectional view of a sensor according to a second embodiment of the present invention.

This embodiment is the same as the first embodiment except for a shape of a sensor housing. Thus, only characterized parts of the current embodiment will be principally described below, and descriptions of the same part as that of the first embodiment will be quoted from the first embodiment.

Referring to FIG. 15, a sensor 370 according to a second embodiment includes a sensor housing 371. The sensor housing 371 includes a seating wall 371*b* on which a first surface 272*a* of a sensor PCB 272 is seated.

Here, unlike the first embodiment, a portion of the first surface 272*a* of the sensor PCB 272 is seated on the seating wall 371*a*, and the other portion is separated from the seating wall 371*a*.

The seating wall 371*a* may include a recessed groove 371*b* so that the other portion of the first surface 272*a* of the sensor PCB 272 is spaced apart from the seating wall 271*b*.

In another aspect, the seating wall 371*a* may include a protruding portion protruding to support a portion of the first surface 272*a* of the sensor PCB 272.

In any case, a space is defined between the seating wall 371*a* and the first surface 272*a* of the sensor PCB 272, and a molding material 276 may be filled into the space.

In this embodiment, thermal conductivity of the molding material 276 is greater than the thermal conductivity of the sensor PCB 272.

As described in the first embodiment, it is necessary to minimize the thermal deformation of the sensor housing 371. In this embodiment, the molding material 276 within the sensor housing 371 is not only disposed at the side of the sensor PCB 272, but also disposed between the sensor PCB 276 and the seating wall 371*a*. Thus, the molding material 276 directly transfers heat of a heat generating element to the sensor housing 371. Thus, heat dissipation performance of the sensor housing 371 may be further improved.

Figure 16:
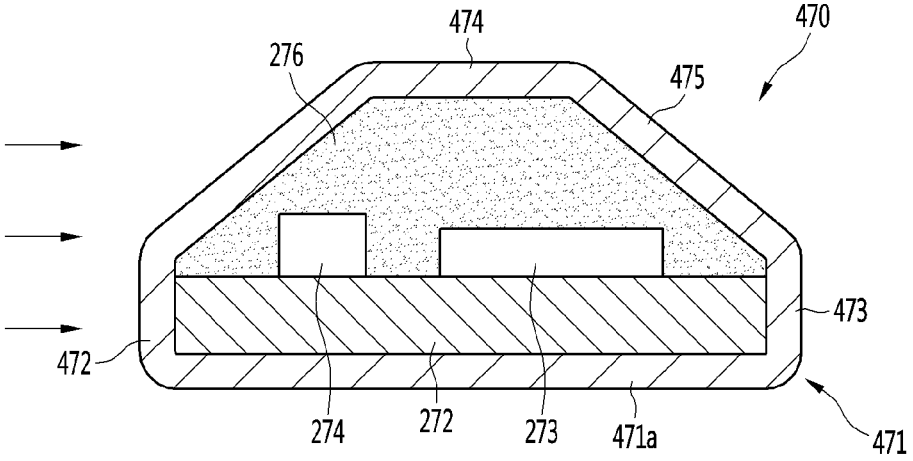
FIG. 16 is a cross-sectional view of a sensor according to a third embodiment of the present invention.

FIG. 16 is a cross-sectional view of a sensor according to a third embodiment of the present invention.

The current embodiment is the same as the first embodiment except for a shape and material of a sensor housing. Thus, only characterized parts of the current embodiment will be principally described below, and descriptions of the same part as that of the first embodiment will be quoted from the first embodiment.

Referring to FIG. 16, a sensor 470 according to a third embodiment of the present invention includes a sensor housing 471.

The sensor housing 471 may be, for example, a metal material. Since the sensor housing 471 is made of a metal material, thermal conductivity is higher than that of a plastic housing.

Thus, sensitivity of the sensing element 274 according to a flow rate of air may be improved.

The sensor housing 471 may be made of, for example, aluminum or stainless steel.

When the sensor housing 471 is made of the metal material, a thickness of the sensor housing 471 may be reduced, and a heat generation volume may be reduced.

When the heat generation volume of the sensor housing 471 is reduced, an influence of the flow rate of the air flowing through a bypass passage 230 may increase. That is, as the heat generation volume decreases, a change in temperature due to heat of the heating element may increase, and a change in temperature may increase according to the flow rate of the air.

However, when the sensor housing 471 is made of the metal material, since it is difficult to manufacture a complex shape, the sensor housing 471 having a simple structure may be manufactured when compared to the sensor housing 471 made of a plastic material, For example, the sensor housing 471 includes a seating wall 471*a* on which the sensor PCB 272 is seated, a front wall 472 and a rear wall 473, which extend from the seating wall 471*a*, and a cover wall 474 connecting the wall 472 to the rear wall 473.

The cover wall 474 may be spaced apart from the sensor PCB 272, the sensing element 274, and the heating element 273.

The cover wall 474 may be provided so that a cross-sectional area that is cut in a direction parallel to an air flow direction decreases as the cover wall 474 is away from the sensor PCB 272. For example, the cover wall 474 may include an inclined wall 475 extending in an approaching direction as the cover wall 474 is away from the front wall 472 and the rear wall 473.

An air flow may be smoothed by the inclined wall 475, and also, defrosting water flowing through the bypass passage 230 may be prevented from being condensed on a surface of the sensor housing 471.

Figure 17:
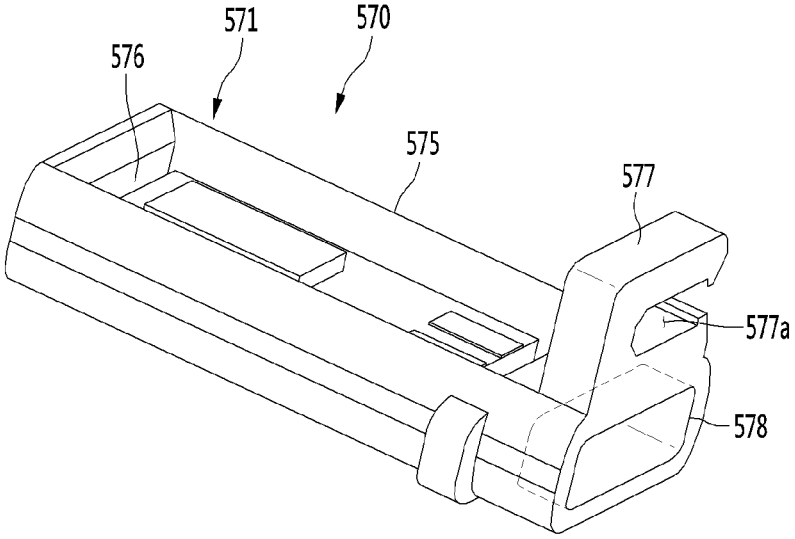
FIG. 17 is a perspective view of a sensor according to a fourth embodiment of the present invention.
Figure 18:
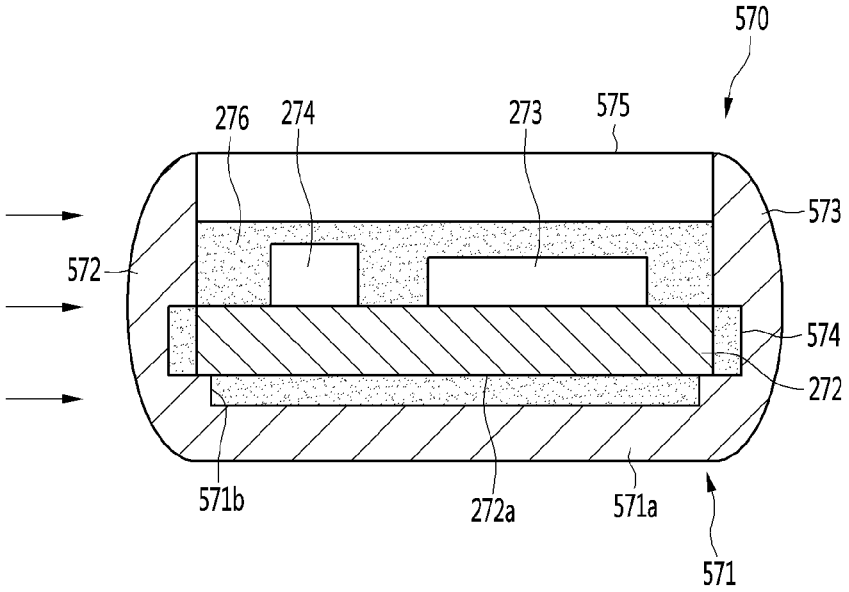
FIG. 18 is a cross-sectional view of the sensor according to the fourth embodiment of the present invention.

FIG. 17 is a perspective view of a sensor according to a fourth embodiment of the present invention, and FIG. 18 is a cross-sectional view of the sensor according to the fourth embodiment of the present invention.

FIG. 17 illustrates a sensor in a state in which a molding material is not filled, and FIG. 18 illustrates a sensor in a state in which the molding material is filled.

The current embodiment is the same as the first embodiment except for a shape and material of a sensor housing. Thus, only characterized parts of the current embodiment will be principally described below, and descriptions of the same part as that of the first embodiment will be quoted from the first embodiment.

Referring to FIGS. 17 and 18, a sensor 570 according to a fourth embodiment of the present invention includes a sensor housing 571.

The sensor housing 571 may include a seating wall 571*a* and a front wall 572 and a rear wall 573, which extend from the seating wall 571*a*.

A recessed groove 571*b* may be defined in the seating wall 571*a* so that a portion of a first surface 272*a* of the sensor PCB 272 is spaced apart from the seating wall 571*a*.

In another aspect, the seating wall 571*a* may include a protruding portion protruding to support a portion of the first surface 272*a* of the sensor PCB 272.

In any case, a space is defined between the seating wall 571*a* and the first surface 272*a* of the sensor PCB 272, and a molding material 276 may be filled into the space.

Also, a groove 574 filled with a molding material 276 may be defined in at least one of the front wall 572 and the rear wall 573. A heat generation volume of the sensor housing 571 may be reduced by the groove 574, and heat may be effectively transferred to the sensor housing 571 by the molding material disposed in the groove 574.

The sensor housing 571 may further include both sidewalls 576. In the sensor housing 571, an exposure opening 575 is defined in an opposite side of the seating wall 571*a*.

According to this embodiment, the sensor PCB 272 may be accommodated in the sensor housing 571 through the exposure opening 575. Also, a molding material 276 may be injected into the sensor housing 571 through the exposure opening 575. Then, after the molding material 276 is injected and hardened, the molding material 276 is exposed to the outside by the exposure opening 575.

According to this structure, air in the bypass passage 230 may directly contact the molding material 276. According to the present invention, since there is no wall serving as heat resistance at a portion corresponding to the exposure opening 575, a reaction speed of the sensing element 274 may increase.

Since the molding material is injected through the exposure opening 575, a wire may also extend to the outside of the sensor housing 571 through the exposure opening 575.

However, in the case of this embodiment, since a gap between the exposure opening 575 and the sensor PCB 272 is small, the molding material 276 injected into the sensor housing 571 may flow to the outside of the sensor housing along the wire. In this state, the molding material 276 may be hardened. In this case, since the molding material 276 is hardened in a state of being integrated with the wire, there is a fear that the wire is broken in a process of bending the wire to connect the wire to a connector (not shown).

Thus, in this embodiment, the sensor housing 571 may be provided with a hook-type fixing guide 577 for fixing a position of the wire connected to the sensor PCB 272 outside the sensor housing 571.

When the molding material 576 is injected into the sensor housing 571 by the fixing guide 577 while the wire is placed in the space 577*a* defined, since the molding material 576 does not move up to the fixing guide 577, even if the wire passing through the space 577*a* move, there is no fear that the wire is damaged.

Since the fixing guide 577 is additionally provided in the sensor housing 571, a groove 578 may be provided in a lower portion of the fixing guide 577 in the sensor housing 571 to reduce the increasing heat generation volume.

In the case of the above embodiment, the structure of the sensor housing 571 is complicated by the fixing guide 577, and even when the groove 578 is defined, the heat generation volume of the sensor housing increases.

Therefore, according to another embodiment, it is also possible to remove the fixing guide 577 from the sensor housing 571 and form a shape of the fixing guide 577 in the cold air duct 20. In this case, the fixing guide 577 may be disposed at a position spaced apart from the bypass passage 230 in the cold air duct 20.

Also, a portion of the fixing guide 577, which passes through the space 577*a*, may be connected to the connector. Therefore, even if the portion of the fixing guide 577, which passes through the space 577*a*, moves, there is no fear that the wire is damaged.

The invention claimed is:

1. A refrigerator comprising:

an inner case defining a storage space and including a rear wall;

a cool air duct to guide a flow of air within the storage space, the cool air duct defining a heat-exchange space together with the rear wall of the inner case;

an evaporator disposed in the heat-exchange space between the rear wall of inner case and the cool air duct;

a bypass passage disposed at the cool air duct, the bypass passage to allow a portion of the air flow to bypass the evaporator;

a sensor disposed in the bypass passage, the sensor comprising a sensor housing, a sensor printed circuit board (PCB) accommodated in the sensor housing, a heat generating element installed on the sensor PCB to generate heat when current is applied, a sensing element to sense a temperature of the heat generating element, and a molding material filled in the sensor housing to surround the sensor PCB, the heat generating element and the sensing element;

a defroster to remove frost generated on a surface of the evaporator; and a controller configured to control the defroster based on an output value of the sensor.

2. The refrigerator of claim 1, wherein the sensing element is installed on the sensor PCB and disposed upstream of the heat generating element with respect to the flow of the portion of air in the bypass passage.

3. The refrigerator of claim 2, wherein the bypass passage is elongated at the cool air duct, the sensing element and the heat generating element are arranged in the bypass passage, and the sensing element is disposed below the heat generating element with respect to the flow of the portion of air in the bypass passage.

4. The refrigerator of claim 2, wherein a first direction is a direction in which the portion of air flows in the bypass passage, and the sensing element is disposed in a line that bisects a left and right width of the heat generating element with respect to a second direction perpendicular to the first direction on the sensor PCB.

5. The refrigerator of claim 1, wherein the sensor housing comprises:

a seating wall on which the sensor PCB is seated;

front and rear walls extending upward from front and rear ends of the seating wall with respect to the portion of air flow direction, respectively;

a sidewall to connect the front wall to the rear wall;

a cover wall to connect the front wall to the rear wall, the cover wall covering the heat generating element and the sensing element; and an opening defined in an opposite side of the sidewall, wherein the sensor PCB is accommodated in the sensor housing through the opening.

6. The refrigerator of claim 5, wherein the molding material is hardened after being injected into the sensor housing through the opening to surround the sensor PCB, the sensing element, and the heat generating element.

7. The refrigerator of claim 5, wherein a first direction is a direction in which the portion of air flows in the bypass passage, and a length of the sensor PCB in a second direction perpendicular to the first direction is less than a length of the sensor housing so that the sensor PCB is spaced apart from the opening, and a portion of the molding material is disposed between the sensor PCB and the opening.

8. The refrigerator of claim 7, wherein the sensor PCB contacts the sidewall disposed at an opposite side of the opening in the sensor housing.

9. The refrigerator of claim 5, wherein a groove having a recessed shape or a protrusion having a protruding shape is provided at the seating wall so that a portion of the seating wall is spaced apart from the sensor PCB.

10. The refrigerator of claim 5, wherein the cover wall is spaced apart from the heat generating element and the sensing element, and a portion of the molding material is disposed between the cover wall and the heat generating element and between the sensing element and the cover wall.

11. The refrigerator of claim 5, wherein the cover wall comprises a rounded portion to reduce passage resistance of the portion of air.

12. The refrigerator of claim 5, wherein one or more of a connection portion between the front wall and the seating wall and a connection portion between the rear wall and the seating wall is rounded.

13. The refrigerator of claim 5, wherein the cover wall is provided so that a cross-sectional area of the cover wall that faces the sensor PCB decreases as the cross-sectional area is distanced away from the sensor PCB.

14. The refrigerator of claim 1, wherein the sensor housing comprises:

a seating wall on which the sensor PCB is seated;

a front wall and the rear wall extending upward from a front end and a rear end of the seating wall with respect to the portion of air flow direction, respectively;

two sidewalls to connect the front wall to the rear wall and opposing each other; and an exposure opening defined in an opposite side of the seating wall, wherein the sensor PCB is accommodated in the sensor housing through the exposure opening, and the molding material is exposed to an outside through the exposure opening.

15. The refrigerator of claim 14, wherein a fixing guide having a hook shape to fix a wire connected to the sensor PCB is provided on the sensor housing.

16. The refrigerator of claim 1, wherein the cool air duct comprises a bottom wall and two sidewalls, which define the bypass passage, a passage cover comprising a cover plate to cover the bypass passage in a state of being spaced apart from the bottom wall, and the sensor disposed to be spaced apart from the bottom wall and the cover plate in the bypass passage.

17. The refrigerator of claim 1, wherein, when a difference value between a temperature sensed by the sensing element in a state in which the heat generating element is turned on and a temperature sensed by the sensing element in a state in which the heat generating element is turned off is equal to or less than a reference temperature value, the controller is configured to operate the defroster.

18. The refrigerator of claim 9, wherein the seating wall comprises the groove having the recessed shape and a portion of the molding material is disposed in the recessed groove between the sensor PCB and the opening seating wall.

19. The refrigerator of claim 5, further comprising a groove defined in at least one of the front wall and the rear wall, wherein a portion of the molding material fills the groove.

20. The refrigerator of claim 5, wherein the cover wall comprises a PCB cover portion to cover a portion of a top surface of the sensor PCB such that a movement of the sensor PCB is restricted between the PCB cover portion and the seating wall.

* * * * *